US005201578A

United States Patent [19]

Westmoland

[11] Patent Number: 5,201,578

[45] Date of Patent: Apr. 13, 1993

[54] LIGHTED JEWELRY

[76] Inventor: Randy C. Westmoland, P.O. Box 92, Skiatook, Okla. 74070

[21] Appl. No.: 739,856

[22] Filed: Aug. 2, 1991

[51] Int. Cl.[5] ..... F21L 15/08

[52] U.S. Cl. ..... 362/104; 362/252; 362/800; 362/806; 63/1.1

[58] Field of Search ..... 362/103, 104, 800, 195, 362/191, 200, 806; 63/13

[56] References Cited

U.S. PATENT DOCUMENTS 4,271,457 6/1981 Martin ..... 362/104
4,638,409 1/1987 Berman ..... 362/103
4,719,544 1/1988 Smith ..... 362/104
4,802,070 1/1989 Westmoland ..... 362/800

*Primary Examiner*—James C. Yeung
*Attorney, Agent, or Firm*—Sherman and Shalloway

[57] ABSTRACT

An article of jewelry comprising a body having two plate members which sandwich a battery between them and having lighting elements electrically connected between the plate members to be illuminated by the battery. A circuit element in the form of a removable microchip and carrier is attachable to one of the plate members providing a means to control the characteristics of the illumination. The construction of the article renders it susceptible to easier assembly whether by manual or automatic means.

37 Claims, 2 Drawing Sheets

LIGHTED JEWELRY

BACKGROUND OF THE INVENTION

This invention relates to lighted or illuminated jewelry and particularly to such jewelry in which the jewelry item itself is part of the electrical circuit. Furthermore, this invention relates to illuminated jewelry which lends itself to simplified manual construction or to automated means of assembly.

Illuminated jewelry has been known in the art for some time but most items involve a complex construction or electrical circuit which renders assembly difficult and expensive. Other constructions require careful manipulation of the electrical contacts between the illuminating member and the battery. A primary shortcoming in most illuminated jewelry is that separate contact means for establishing the electrical connection with the battery must be fabricated and added to the jewelry item. An improvement in illuminated jewelry wherein the components of the electrical circuitry also form part of the jewelry, i.e. decorative effect, as described in my previously issued U.S. Pat. No. 4,802,070. However, still further improvements and simplification of structure are desired.

SUMMARY OF THE INVENTION

According to one embodiment of the invention, there is provided an article of jewelry which includes a body having first and second plate members held in parallel and spaced apart relationship by resilient means, an electrically conductive means associated therewith. At least one lighting element having two electrically conductive (i.e. positive and negative) leads are electrically conductively attached to each plate member, with one lead connected to the electrically conductive means on one plate member and the other lead connected to the electrically conductive means on the opposed plate member. A battery, e.g. a coin shaped battery, is sized to fit between and be confined by and contact the plate members and the electrically conductive means. When the jewelry is assembled with the battery secured between the plate members, an electrical circuit is completed to conduct electricity through the electrically conductive means and the lighting element leads to illuminate the lighting element(s).

In another embodiment incorporating features of the above-described embodiment, contact means are provided on the facing surfaces of the first and second plate members, with the contact means on the second plate member being electrically connected to the lighting element lead(s) connected to that plate member. Electrical circuit means for controlling the characteristics of the illumination, including for example, activation stimuli, is provided on the first plate member in electrical contact between the contact means of the first plate member and the lighting element lead(s) connected to the first plate member. The electrical circuit means is typically a microchip.

Accordingly, it is an object of this invention to provide an article of jewelry in which the entire ornamental structure of the jewelry forms the electrical contacts for connection to a battery.

It is a further object of this invention to provide an article of jewelry in which the illuminating means are simply connected to the body of the article with no intervening structure for direct electrical contact with the battery.

It is a still further object of this invention to provide an article of jewelry in which the quality of illumination and the outer appearance of the article are changeable.

It is a still further object of this invention to provide an article of jewelry which may be easily configured for use as virtually any type of jewelry and with virtually any type of fastener. For example, an ear clasp may be connected to the article of jewelry allowing it to be worn as an earring for pierced or non-pierced ears. The article may also be configured for use on a clothing pin, a hair pin, a necklace, a bracelet, a ring, etc.

The article of jewelry of the present invention includes at least one electrically activated light source connected between two plates which function as both the body of the article of jewelry and the electrical contacts with and holder for a battery. The plates are spaced apart a sufficient distance to allow insertion and holding of a flat, button type battery and are themselves electrically insulated from each other so that insertion of the battery completes an electrical circuit. The article also includes simple means for attachment of the light source between the two plates as an integral part of a simple electrical circuit.

The two plates are preferably of a size and shape whereby the battery will be entirely confined between them; however, it is envisioned that other shapes and sizes may be employed which would allow a portion of the battery to be visible. In such cases the battery will itself be part of the ornamental structure of the article of jewelry. It is important that the battery be securely maintained between the two plates yet be easily removed for replacement. Accordingly, the plates are connected by resilient means which allow the plates to be spread for insertion or removal of the battery but also provide a clamping action to hold the battery in place. The resilient means may also provide electrical insulation between the two plates or, in another embodiment, may be electrically conductive members within the circuit.

DETAILED DESCRIPTION OF THE INVENTION

Figure 1:
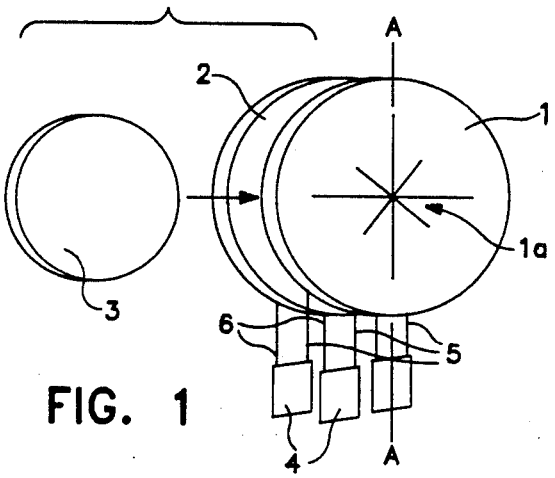
FIG. 1 is a perspective view of one embodiment of the basic construction of the invention.
Figure 2:
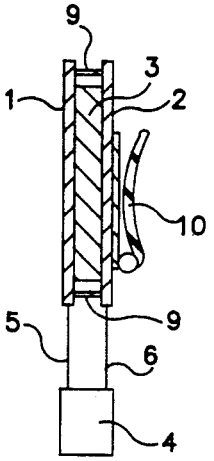
FIG. 2 is a cross section of the construction of FIG. 1 taken along line A—A illustrating the invention with a clip type earring attachment.

FIG. 1 illustrates the basic construction of the present invention as a jewelry article constructed from a pair of plates 1 and 2 which sandwich a battery 3 of the button or thin coin type. Lighting elements 4 attach to the plates 1 and 2 by means of wires or leads 5 and 6. One lead of each lighting element attaches to one plate as shown in FIG. 2 to form a complete electrical circuit. In the embodiment of FIGS. 1 and 2, leads 5 of lighting elements 4 attach to plate 1 and leads 6 attach to plate 2. With battery 3 in place a complete electrical circuit is formed from plate 1 through lead 5, lighting element 4, lead 6, plate 2 and battery 3 to cause the lighting elements 4 to glow. Lighting elements 4 may be incandescent bulbs such as the small "grain of wheat" bulbs, or they may be light emitting diode, LED, devices. Lighting elements 4 may also be mounted so as to be suspended from the article by their leads 5 and 6 or the leads may be shortened so that the lighting elements 4 are positioned close against the edge of the jewelry article. The number of lighting elements 4 used is dependent on individual preference for the particular design and the relative sizes of the plates 1 and 2 and the lighting elements 4.

Plates 1 and 2 form the body of the jewelry article as well as the positive and negative battery contacts and the battery holder and may be made in any desired shape or size provided there is sufficient structure to support and retain the battery 3 and provide electrical contact therewith. In so doing they are preferably formed from an electrically conductive material to which the battery and the lighting elements may be directly attached. The plates 1 and 2 are interchangeable as far as the basic construction; however, for the purposes of this disclosure it is considered that plate 1 is the outermost plate and the one which will generally be visible when the jewelry article is worn. Accordingly, the outer surface of plate 1 may have an ornamental design 1*a* etched or embossed into it or one or more jewels may be attached to the surface for decoration. Furthermore, each of, or either of, plates 1 and 2 may have its outer surface or both surfaces coated or electroplated with a decorative coating, such as silver, gold, enamel, etc.

Figure 3:
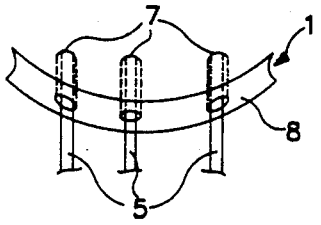
FIG. 3 is a close up of the lower edge of one of the plates of the construction of FIG. 1 showing the attachment of the lighting element leads to one of the plates.

FIG. 3 illustrates a preferred method of attachment wherein holes 7 are drilled or cast into the edge 8 of plate 1. Leads 5 are inserted into the holes 7 and secured in place by solder or other means The second set of leads 6 from the lighting elements 4 are secured to plate 2 in the same or similar manner.

Plates 1 and 2 are held parallel to each other spaced apart a distance which is sufficient to allow insertion and removal of battery 3 yet such as to provide clamping or friction so that the battery 3 will not inadvertently fall out. Additionally, this connection between plates 1 and 2 must be non-conductive to prevent shorting of the electrical circuit between the two plates Toward this end it is preferred that the plates 1 and 2 be held together in their spaced relationship by non-conductive resilient means 9 as shown in FIG. 2. This resilient means may be in the form of short sections of material, the ends of which are attached to opposing plates 1 and 2 in a manner to allow one to slightly spread the plates for insertion and removal of the battery 3. The length of these sections when relaxed should be such that the distance between the plates 1 and 2 is just the width of battery 3 or, preferably, just slightly less than the width of the battery 3. The latter condition is preferred to ensure good contact between the plates 1 and 2 and the battery 3 and to apply a slight clamping force to the battery 3 by the plates 1 and 2 thereby preventing it from being inadvertently dislodged. In either case the inner surface of each plate is preferably roughened to increase friction between the plates 1 and 2 and the battery 3.

FIG. 2 illustrates the article of the invention with a standard spring clip earring attachment 10 applied to the outer surface of plate 2. It is within the limits of this invention to include any type of jewelry attachment means depending on the use to be made of the invention. Accordingly attachments such as the aforementioned spring clip earring means, screw back earring clips, pierced earring posts or wires, brooch pins, clips, buckles, loops for attachment to necklaces and bracelets and the like may be applied to the jewelry article of the present invention.

In the preferred embodiment illustrated in FIGS. 1, 2 and 3, the plates 1 and 2 are preferably made from a metal having sufficient conductivity to transmit the electricity of the battery 3 to the lighting elements 4. Other constructions of the plates are envisioned and FIGS. 6 and 7 are illustrative.

Figure 6:
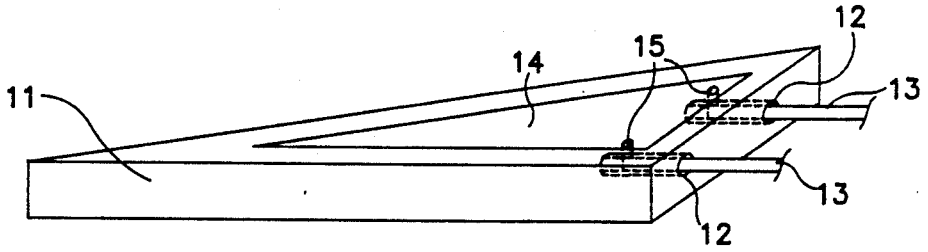
FIG. 6 is a perspective view of an alternative embodiment for the plates of the present invention.
Figure 7:
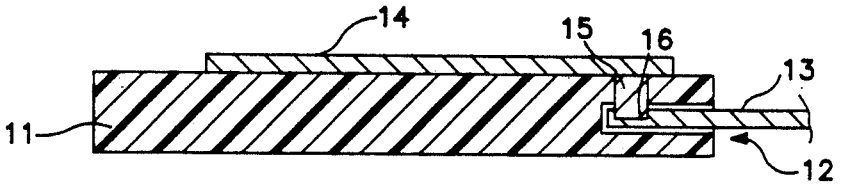
FIG. 7 is a cross section of the alternative embodiment of FIG. 6 taken along a line passing through one of the lighting element leads.

In FIG. 6 a plate 11 is made from a non-conductive material such as plastic. One edge is provided with holes 12 into which leads 13 from lighting elements are inserted. Across one surface is applied a sheet 14 of conductive material having pins 15 which pierce the plate material at points calculated to intersect holes 12 and allow the pins to contact leads 13. This is shown more clearly in FIG. 7 which is a cross section of FIG. 6. Sheet 14 is preferably a preformed thin sheet of metal with pins 15 having sharp points which may be pushed into the material of plate 11. Alternatively plate 11 may have a second set of holes 16 drilled or cast into it at locations to intersect holes 12 and to accept pins 15 and the sheet 14 may be glued or heat sealed to the surface of plate 11.

In a further alternative embodiment, sheet 14 and its associated pins 15 may be formed by applying a conductive paste or similar material to the surface of plate 11, the plate having the second set of holes 16 formed therein and the paste being allowed to flow into these holes 16. Preferably in this further alternative embodiment the leads 13 will be inserted into holes 12 before the conductive paste is applied so that the paste which flows into holes 16 will also serve to electrically contact leads 13 and secure them in place within holes 12. As a further alternative, the leads 13 may be inserted into holes 12 after application of the conductive paste but before the paste has had a chance to set.

In the basic form of the invention so far described, insertion of battery 3 between plates 1 and 2 will cause the lighting elements to be illuminated and to glow continuously. It is envisioned that it may be desirable to add other characteristics to the illumination or to render such characteristics subject to external stimuli such as sound, heat or the like. Toward this end, FIGS. 4 and 5 illustrate a further embodiment of the present invention wherein custom designed microchip elements may be attached to the article of jewelry in the circuit between the battery 3 and lighting elements 4 to control any desired characteristics of the illumination.

Figure 4:
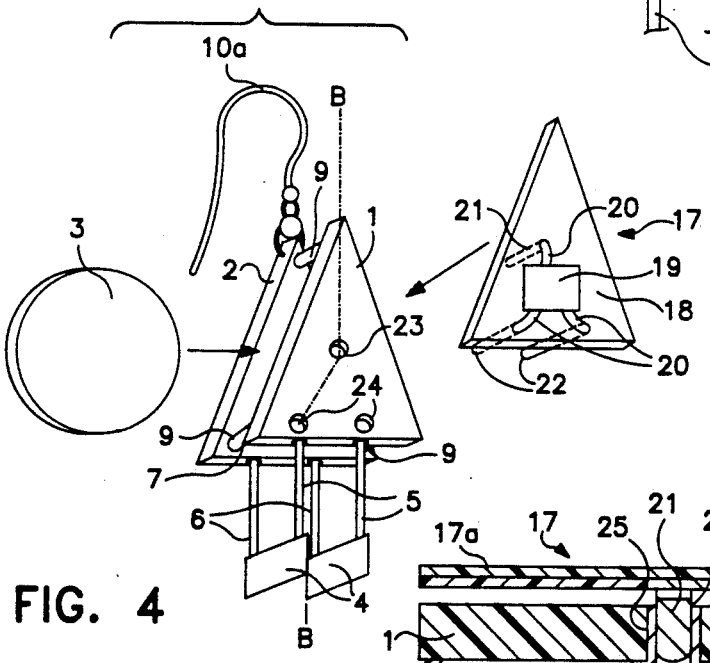
FIG. 4 is a perspective view of an alternative embodiment of the jewelry article of the invention.
Figure 5:
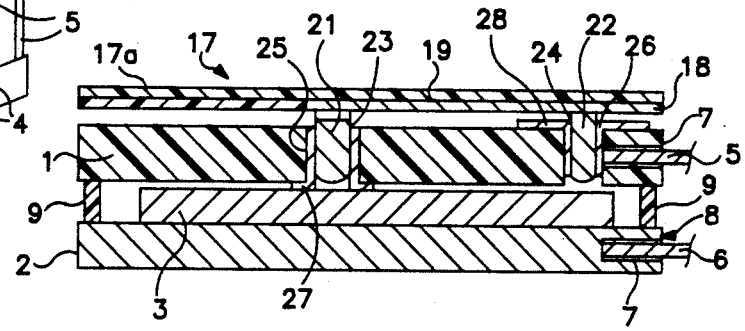
FIG. 5 is a cross section of the embodiment of FIG. 4 taken along line B—B.

In FIG. 4, the basic construction of the plates 1 and 2, battery 3, lighting elements 4 and leads 5 and 6 attached to their respective plates via holes 7 is substantially the same as in FIG. 1. In addition, resilient connectors 9 between plates 1 and 2 are included. A pierced earring wire 10*a* is shown here as the jewelry attachment means; however, it is pointed out that, as before, any type of attaching means may be employed.

This embodiment includes a changeable microchip element 17 which is attachable to one of the plates 1 and 2. In the illustration the microchip element 17 is shown as being attached to plate 1; however, the jewelry article may be designed so that the microchip element is attachable to plate 2. Microchip element 17 may have a decorative design or attachment 17*a* on its outer surface, particularly if it is to be attached to plate 1.

Microchip element 17 comprises a body 18 of non-conductive material on which is located a microchip 19 comprising circuitry to control the illumination of lighting elements 4. Decorative element 17*a* may be layered over body 18 and microchip 19 providing not only a decorative surface but also protection for the microchip 19. Lead traces 20 connect the microchip 19 to contact pins 21 and 22 extending from the underside of the microchip element 17. Alternatively, the contact pins 21 and 22 may extend directly from the microchip 19 without intervening lead traces 20. The microchip may be designed to provide a controlled pattern of flashing to the lighting elements or to respond to external stimuli such as heat, sound, ambient lighting, movement or the like to affect the characteristics of the illumination pattern or strength of the lighting elements in response to such stimuli. To effect such control the microchip element is attachable to either plate 1 or plate 2 in such a manner as to be included in the circuit between the battery 3 and the lighting elements 4. FIG. 5 illustrates one manner in which such incorporation into the circuit of the jewelry article may be achieved.

In order for the microchip element 17 to control illumination there must not be a direct connection between one set of the lighting element leads 5 or 6 and the battery 3. For convenience and purposes of illustration the incorporation of microchip element 17 will be discussed as being between battery 3 and leads 5 as they are attached to plate 1. It is pointed out that the same construction could be effected between battery 3 and leads 6 attached to plate 2.

As shown in FIG. 4, and in cross section in FIG. 5, plate 1 is provided with a central aperture 23. This aperture 23 has a location corresponding to contact pin 21 on microchip element 17 and is sized to accept pin 21. Aperture 23 also extends completely through plate 1. Along the edge of plate 1 and corresponding to the holes 7 in which leads 5 are located are edge apertures 24, one for each lighting element lead 5, which extend through plate 1 and intersect lighting element lead holes 7. These edge apertures 24 are located and sized to accept contact pins 22 extending from microchip element 17 to provide electrical contact between microchip 19 and lighting element leads 5.

Referring to FIG. 5, it is seen that within apertures 23 and 24 are located contact sleeves 25 and 26. These sleeves are of simple construction providing gripping contact for contact pins 21 and 22 and may be press fit into the apertures 23 and 24. The sleeves 25 and 26 preferably have circular flanges 27 and 28 extending radially outward from one end providing a surface to butt against the surface of plate 1 thereby preventing them from pushing completely through the apertures 23 and 24. Sleeve 25 is inserted into aperture 23 from the inner surface of plate 1 so that its flange 27 will also serve as a positive contact for the battery 3. In contrast sleeves 26 are inserted into apertures 24 from the outer surface of plate 1, their flanges 28 serving to prevent them from having direct contact with battery 3. The sleeves 25 and 26 are of a length which is shorter than the thickness of plate 1 such that they do not extend completely through the plate but provide a gripping contact within apertures 23 and 24 for contact pins 21 and 22. Because apertures 24 intersect the lighting element lead holes 7 of plate 1, contact sleeves 26 inserted therein also provide electrical contact with leads 5 inserted into holes 7, thereby assuring contact between microchip 19 and lighting elements 4 via lead traces 20 and contact pins 22.

This construction allows the microchip element 17 to be removed and changed. Different microchip elements may be provided so that the user may change them to achieve different lighting effects with the jewelry item, the microchip elements being produced in sizes and shapes to match the particular sizes and shapes of the jewelry elements. Additionally, microchip elements will preferably have the same number of contact pins 24 as the jewelry item has lighting elements 4 so that each lighting element 4 may be separately controlled by the circuitry of microchip 19.

The embodiment illustrated in FIG. 5 is depicted as having plate 2 made from a conductive metal and being attached to plate I by the appropriate resilient means 9 to provide the necessary retention force for battery 3. As discussed with regard to the basic construction of FIGS. 1, 2 and 3, plate 2 is provided with holes 7 in its edge 8 in which leads 6 are inserted and secured by solder or the like. Alternatively, the plate embodiment of FIGS. 6 and 7 may be employed in place of the metal construction for plate 2.

Figure 8:
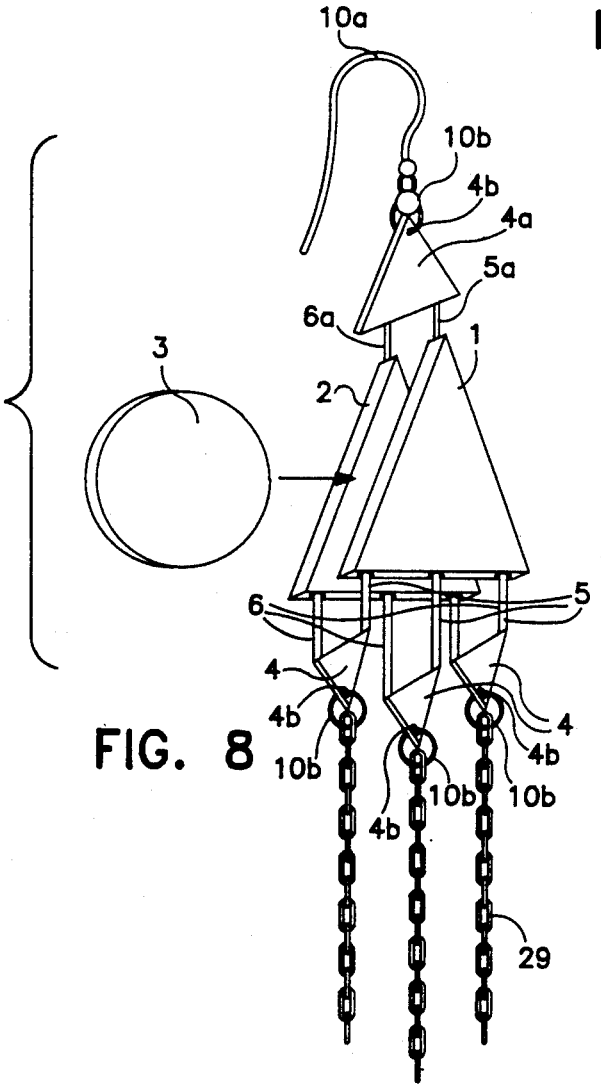
FIG. 8 is a perspective view of a further alternative embodiment of the jewelry article of the present invention.

FIG. 8 illustrates an alternative embodiment wherein the means by which plates 1 and 2 are held in their parallel spaced relationship form part of the overall circuit. In this instance, lighting elements 4 and their leads 5 and 6 serve as the resilient connection means between the plates 1 and 2. Leads 5 and 6 of lighting element 4*a* at the upper apex of plates 1 and in place of the non-conductive resilient means 9 of FIG. 2. Leads 5 and 6 of lighting element 4*a* correspond to the leads of the other lighting elements. The effect, in the embodiment shown, is to place resilient connection means at each apex of the illustrated structure. Of course, other shapes of plates will have sufficient connecting means, whether of the non-conductive resilient type 9 or appropriate lighting elements 4, 4*a* to provide the necessary support and clamping force. Where lighting elements 4, 4*a* are used in this manner they will also serve in their decorative and illuminative capacities since they will electrically connect the plates 1 and 2 by their leads 5 and 6 in a proper circuit.

Figure 8A:
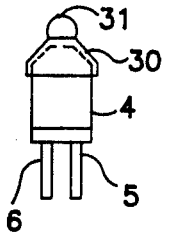
FIG. 8A is an alternative embodiment for the lighting elements employed in this invention.

As a further feature of the embodiment of FIG. 8, lighting element 4*a* is also the means whereby a pierced earring wire 10*a* or other attachment means may be attached to the jewelry item. In this case, a small hole 4*b* and a split ring 10*b* placed therein, whereby the earring wire 10*a* or other means is attached. Hole 4*b* is placed so as not to disrupt the envelope of lighting element 4*a*. Alternatively, a small cap 30 with a loop means 31 may be epoxied or glued in place on the end of lighting element 4*a* and the earring wire 10*a* or other attachment means connected thereto. FIG. 8A illustrates such an arrangement.

In a similar fashion, lighting elements 4 may be provided with holes 4*b* in which split rings 10*b* may be inserted. Alternatively, the cap 30 and loop 31 of FIG. 8A may also be used. Attachable to either the split rings 10*b* or loop 31, whichever is used, may be decorative elements 29, in this case fine chains. Alternatively, charms, small crystals, reflectors or other such elements having interesting or pleasing visual effects may be so attached. Furthermore, the constructions of FIGS. 4, 5, 6 and 7 regarding the inclusion of a controlling microchip, the methods of attachment and electrical connection of leads 5 and 6 and the conductive structures of plates 1 and 2 are also suitable for inclusion in the embodiment of FIG. 8.

While the invention has been described with a certain degree of particularity, it is manifest that many changes may be made in the details of construction and the arrangement of components without departing from the spirit and scope of this disclosure. It is to be understood that the invention is not limited to the embodiments set forth herein for purposes of exemplification, but is to be limited only by the scope of the attached claims including the full range of equivalency to which each element thereof is entitled.

What is claimed is:

1. An article of jewelry, comprising:

a body consisting of first and second plate members, each of said first and second plate members having an upper surface, a lower surface, and an outside edge positioned between said upper surface and said lower surface, said first and second plate members being held in parallel and spaced apart relationship by resilient means and having electrically conductive means associated therewith, at least one lighting element having two electrically conductive leads, a battery sized to fit between and be confined by and contact said plate members and said electrically conductive means, means to attach said article of jewelry to a person or an article of clothing, wherein each of said plate members is provided with at least one hole extending from the outside edge of said plate member into said plate member between said upper surface and said lower surface of said plate member and intersecting said electrically conductive means, said electrically conductive leads are attached in an electrically conductive manner to said plate members, one lead being attached to said first plate member and the other lead being attached to said second plate member by insertion of said leads into said holes, said leads being electrically connected to said electrically conductive means of said plate members via said holes, and said battery supplying electricity through said electrically conductive means and said lighting element leads to illuminate said lighting elements.

2. The article of claim 1 wherein said plate members are made from an electrically conductive material and said resilient means is electrically non-conductive.

3. The article of claim 2 wherein said leads are secured in said holes by solder.

4. The article of claim 1 having decorative means on at least one of said plates.

5. The article of claim 1 wherein said resilient means maintains said plates in a parallel, spaced relationship sufficient to allow insertion and removal of said battery by slight stretching of said resilient means, subsequent relaxation of said resilient means being such as to apply a clamping force between said plate members to hold said battery in place.

6. The article of claim 5 wherein the battery contacting surfaces of said plate members are roughened.

7. The article of claim 5 wherein said resilient means comprises a plurality of lighting elements spaced about the outside edge of said plate members, whereby said leads provide sufficient rigidity to maintain said plates in said parallel and spaced apart relationship and sufficient resiliency to allow insertion and removal of said battery.

8. The article of claim 7 wherein said lighting elements are provided with means for attachment of decorative elements.

9. The article of claim 8 wherein at least one of said lighting elements is provided with means for attachment of said article to the human body.

10. The article of claim 8 wherein at least one of said lighting elements is provided with means for attachment of said article to an item of clothing.

11. The article of claim 1 wherein said plate members are formed from an electrically non-conductive material and have electrically conductive means applied to their facing surfaces, said electrically conductive means forming battery contact surfaces and having means electrically connecting said contact surfaces to said lighting element leads.

12. The article of claim 11 wherein said electrically conductive means comprises an electrically conductively paste applied to said plate members.

13. The article of claim 11 wherein said electrically conductive means comprises a thin metallic plate applied to said facing surface of each of said plate members.

14. The article of claim 11 wherein said means electrically connecting said contact surfaces to said lighting element leads comprise extending traces of said conductive means.

15. The article of claim 1 wherein said leads are secured in said holes by conductive paste.

16. An article of jewelry comprising:

a body consisting of first and second plate members each of said first and second plate members having an upper surface, a lower surface, an outside edge positioned between said upper surface and said lower surface, the first and second plate members being held in parallel, spaced apart relationship by resilient means, a battery sized to fit between and be confined by said plate members, at least one lighting element having two electrically conductive leads, each of the plate members is provided with at least one hole extending from the outside edge of the plate member into said plate members between the upper surface and said lower surface of said plate members, each of said holes having one of said leads secured therein, contact means on the facing surfaces of each of said first and second plate members providing electrical contact with said battery, said contact means on said second plate member being electrically connected to said at least one lighting element lead connected to said plate member, and electrical circuit means on said first plate member electrically connected between said contact means on said plate member and said at least one lighting element lead connected to said plate member, wherein said battery supplying electrical current via said contact means, said circuit means and said lighting element leads to illuminate said lighting element and said circuit means is designed to control the characteristics of such illumination.

17. The article of claim 16 having means for attachment to the human body.

18. The article of claim 17 wherein said means for attachment to said human body is attached to at least one of said lighting elements.

19. The article of claim 16 having means for attachment to an article of clothing.

20. The article of claim 19 wherein said means for attachment to said article of clothing is attached to at least one of said lighting elements.

21. The article of claim 16 wherein said electrical circuit means comprises a microchip mounted on a carrier which is removably attachable to said first plate.

22. The article of claim 21 wherein said first plate member has socket means therein, a first socket being in electrical connection with said battery contact means and at least a second socket being in electrical connection with said at least one lighting element lead, said microchip carrier having contact pins electrically connected to said microchip and extending therefrom and having size and location to register with said socket means when said microchip carrier is attached to said first plate member.

23. The article of claim 22 wherein said microchip carrier is removable from said first plate member.

24. The article of claim 22 wherein said microchip includes means responsive to external stimuli to effect control of the characteristics of lighting element illumination.

25. The article of claim 16 wherein said resilient means comprise a plurality of said lighting elements spaced about the outside edge of said plate members, whereby said electrically conductive leads connect said plate members in a electrical circuit trough said lighting elements and whereby said leads have sufficient rigidity to maintain said plate members in their parallel spaced relationship and sufficient resiliency and spacing about said periphery to allow insertion and removal of said battery.

26. The article of claim 25 having decorative elements attached to said lighting elements.

27. An article of jewelry comprising:

a body comprising first and second plate members held in parallel and spaced part relationship by resilient means, each of said first and second plate members having an upper surface, a lower surface and an outside edge positioned between said upper surface and said lower surface, a battery sized to fit between and be confined by said plate members, a plurality of lighting elements having two electrically conductive leads, one each of said leads being connected to each of said first and second plate members, and at least one hold extending into each of said plate members wherein each of said plate members is provided with at least one hole extending from the outside edge of said plate member into said plate member between said upper surface and said lower surface of said plate member, each of said holes having one of said leads secured therein, wherein when said battery is placed between said plate members it completes an electrical circuit with said lighting elements and supplies current to said lighting elements causing said lighting elements to glow.

28. The article of claim 27 wherein said lighting elements and said leads comprise and resilient means maintaining said plate members in said parallel and spaced apart relationship.

29. The article of claim 28 having decorative means attached to said lighting elements.

30. The article of claim 29 wherein at least one lighting element has associated therewith means for attachment of said article to a human body.

31. The article of claim 29 wherein at least one of said lighting elements has associated therewith means for attachment of said article to an article of clothing.

32. The article of claim 27 wherein said first and second plate members are made from an electrically conductive material and said resilient means is electrically non-conductive.

33. The article of claim 32 wherein said electrically conductive material is metallic and said leads are secured in said holes by solder.

34. An article of jewelry, comprising:

a body consisting of first and second plate members each of said first and second plate members having an upper surface, a lower surface, and an outside edge positioned between said upper surface and said lower surface, said first and second plate members held in parallel relationship by a resilient means and adapted to receive and confine a battery therebetween, at least one lighting element having two electrically conductive leads, means to attach said article of jewelry to a person or an article of clothing, and holes extending into each of said plate members wherein each of said plate members is provided with at least one hole extending from the outside edge of said plate member into said plate member between said upper surface and said lower surface of said plate member, and wherein each of said holes having one of said leads secured therein.

35. The article of claim 34 further comprising resilient means holding said plate members in said parallel and spaced apart relationship whereby said plates may be separated for insertion and removal of a battery.

36. The article of claim 35 wherein said plates are made from electrically conductive material and said resilient means are electrically non-conductive.

37. The article of claim 36 wherein said leads are secured in said holes by solder.

* * * * *